US007048552B2

(12) United States Patent
Sakata et al.

(10) Patent No.: US 7,048,552 B2
(45) Date of Patent: May 23, 2006

(54) CONNECTOR AND PRESS-FITTING JIG USING THEREFOR

(75) Inventors: Tomoyuki Sakata, Mie (JP); Ryosuke Sioda, Mie (JP)

(73) Assignees: Autonetworks Technologies, Ltd., Mie (JP); Sumitomo Wiring Systems, Ltd., Mie (JP); Sumitomo Electric Industries, Ltd., Osaka (JP)

( * ) Notice: Subject to any disclaimer, the term of this patent is extended or adjusted under 35 U.S.C. 154(b) by 0 days.

(21) Appl. No.: 10/842,688

(22) Filed: May 11, 2004

(65) Prior Publication Data

US 2005/0003686 A1 Jan. 6, 2005

(30) Foreign Application Priority Data

May 13, 2003 (JP) ..... 2003-134485

(51) Int. Cl.
*H01R 9/09* (2006.01)

(52) U.S. Cl. ..... 439/79; 439/733.1

(58) Field of Classification Search ..... 439/79, 439/80, 733.1, 943
See application file for complete search history.

(56) References Cited

U.S. PATENT DOCUMENTS 4,550,962 A * 11/1985 Czeschka ..... 439/78
5,453,016 A * 9/1995 Clark et al. ..... 439/79
6,196,853 B1 * 3/2001 Harting et al. ..... 439/79
6,210,180 B1 * 4/2001 Lee et al. ..... 439/79
6,494,724 B1 * 12/2002 Bixler et al. ..... 439/79
6,719,573 B1 * 4/2004 Koehler et al. ..... 439/79
6,835,074 B1 * 12/2004 Sakata ..... 439/79

FOREIGN PATENT DOCUMENTS

JP A 6-224597 8/1994
JP A 10-41026 2/1998

* cited by examiner

*Primary Examiner*—Thanh-Tam Le
(74) *Attorney, Agent, or Firm*—Oliff & Berridge, PLC

(57) ABSTRACT

A connector press-fitting jig is used for press-fitting a plurality of flanged terminals, which are protruded in a common direction from the housing a connector and bent midway in a common direction to extend in parallel and which are provided at their leading ends with press-fit portions and at their portions away from the leading ends with flanged portions bulged in a flange shape, into through holes of a board by guiding the flanged terminals with groove portions. The groove portions have a width within a range larger than the bent portions of the flanged terminals and smaller than the flange portion and are wider at their portions other than their opening ends than at the opening ends.

3 Claims, 7 Drawing Sheets

FIG. 4A
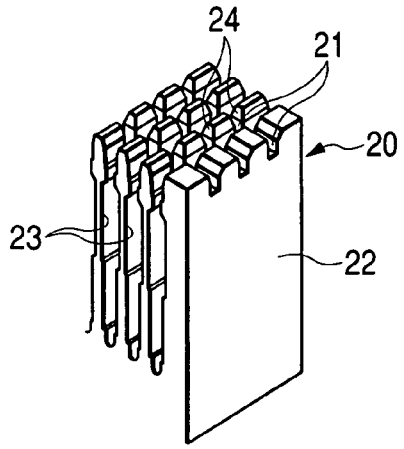
FIG. 4B
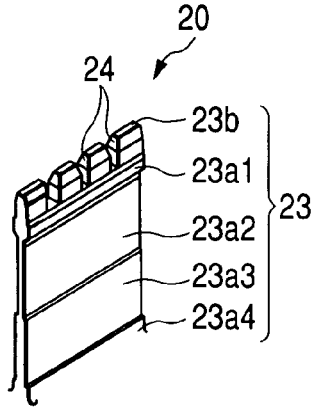
FIG. 5A
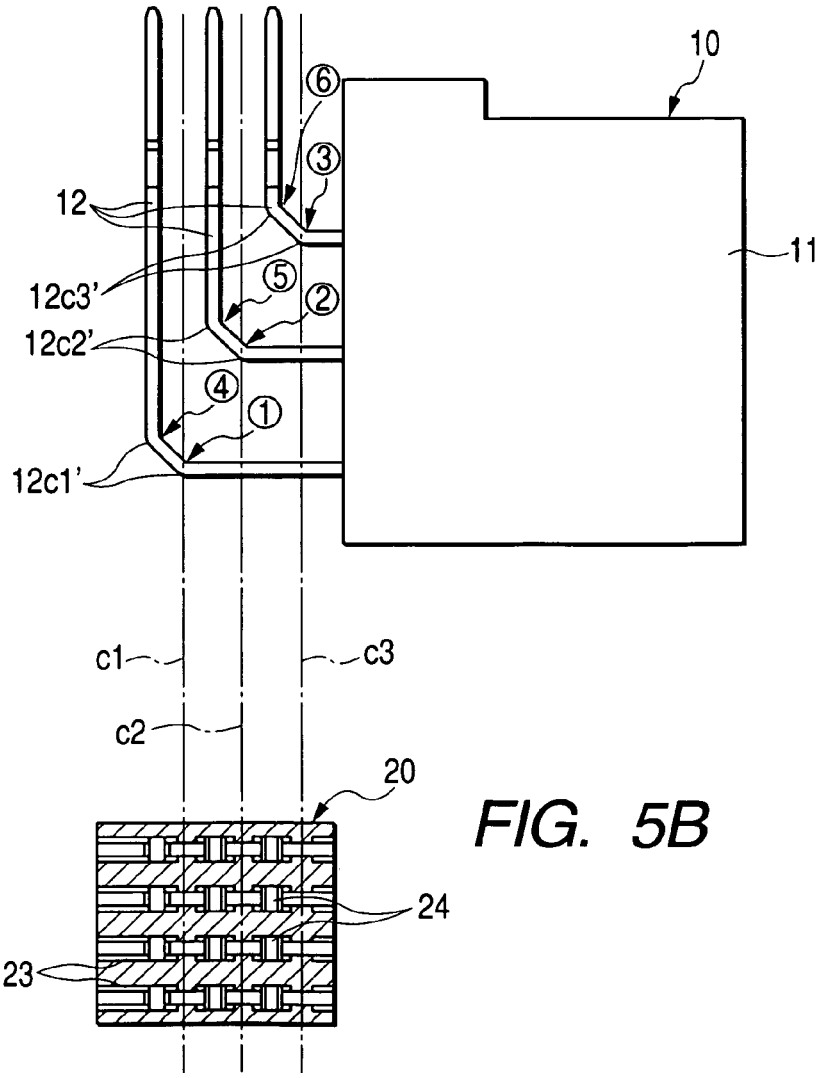
FIG. 5B (RELATED ART)

CONNECTOR AND PRESS-FITTING JIG USING THEREFOR

BACKGROUND OF THE INVENTION

1. Field of the Invention

The present invention relates to a connector and a press-fitting jig for the connector and, more particularly, to a press-fit connector.

2. Description of the Related Art

FIGS. 7A, 7B and 7C are views showing one example of the state before the terminals of a conventional press-fit connector are press-fitted in a board. FIG. 7A is a front elevation containing a section taken along a terminal row closest to this side; FIG. 7B is a side elevation; and FIG. 7C is an enlarged view of a portion of FIG. 7A. FIGS. 8A and 8B are conceptional views showing a connector jig. FIG. 8A is a perspective view showing a deep groove shape, and FIG. 8B is a perspective view showing a portion of FIG. 8A. Here, blanked arrows in FIGS. 7A to 7C indicate the directions, in which the individual parts to be press-fitted are mounted.

In the related art, the so-called "press-fit connector" is widely used as a connector, which is enabled to effect convenient connections requiring no soldering merely by press-fitting the terminals in a board. As this terminal press-fitting method, moreover, there is known the method (as likewise adopted for the so-called "pin connector", which is prepared by soldering the individual terminals to the board, as disclosed in JP-A-6-224597 and JP-A-10-41026), in which, with a plurality of flanged terminals 512 extending from the housing 511 of a press-fit connector 510 being clamped between transversely (of FIG. 7A) arranged comb teeth of a connector jig 520, the flanged portions 512*b* of the individual terminals 512 are pushed with pressure faces 521 of the connector jig 520, as shown in FIGS. 7A to 7C, thereby to press-fit elastic portions 512*a* formed by bulging the leading end portions of the individual terminals 512 in a needle eye shape, in through holes 532 formed in the board body 531 of a printed-circuit board 530. Here, numeral 550 in FIGS. 7A and 7B designates a board jig, against which the printed-circuit board 530 is to be brought into abutment at the press-fitting time. The leading ends of the individual terminals 512 are brought into and protected by bottomed holes 552, which are formed in a jig body 551. As shown in FIGS. 8A and 8B, moreover, the comb teeth of the connector jig 520 are defined by deep grooves 523 and shallow grooves 524, which are formed in a jig body 522. The deep grooves 523 are further composed of inducing portions 523*b* for inducing the terminals 512 and guide portions 523*a* for guiding the induced terminals 512 onto the pressure faces 521. In the related art, moreover, the guide portions 523*a* are defined by parallel faces having a predetermined groove width.

FIGS. 9A, 9B and 9C are views showing the states before and after a bending treatment of a terminal. FIG. 9A is a perspective view of a portion showing the state before the bending treatment of the terminal; FIG. 9B is a perspective view of a portion showing the state after the bending treatment; and FIG. 9C is a top plan view of FIG. 9B.

Each terminal 512 is usually formed by punching a material with a press or the like into a flat plate shape having a terminal width W, as shown in FIG. 9A, and then by pushing the flat plate with a not-shown pushing tool to bend it at a right angle to a predetermined bending radius R. However, this bent portion 512*c* is flattened so that the terminal width W' is known to become larger than the unbent portion (W'>W), as shown in FIG. 9B and FIG. 9C.

In the connector jig 520 of the related art, the comb teeth are usually widely spaced to match the enlarged terminal width W'. In this case, the engaging allowance between the flanged portions 512*b* of the terminals 512 and the pressure faces 521 are reduced to raise such a problem in the worst case that the load necessary for the press-fit cannot be borne.

If the comb teeth are not widely spaced, on the other hand, the terminals 512 and the comb teeth interfere with each other to intensify their contact forces so that the connector jig 520 is hardly set. If the connector jig 520 is to be forcibly set, moreover, the terminals 512 are subjected to an excessive force so that they are deformed to raise another problem that the yield of products is lowered.

SUMMARY OF THE INVENTION

The invention has been conceived to solve the problems of the related art. It is an object of the invention to provide a connector, which can set a connector jig easily and improve the yield of products, and a press-fitting tool for the connector.

According to a first aspect of the invention, there is provided a connector press-fitting jig for press-fitting a plurality of flanged terminals, which are protruded in a common direction from the housing a connector and bent midway in a common direction to extend in parallel and which are provided at their leading ends with press-fit portions and at their portions away from the leading ends with flanged portions bulged in a flange shape, into through holes of a board by guiding the flanged terminals with groove portions, wherein the groove portions have a width within a range larger than the bent portions of the flanged terminals and smaller than the flange portion and are wider at their portions other than their opening ends than at the opening ends.

According to this construction, the groove portions have a width within a range larger than the bent portions of the flanged terminals and smaller than the flange portion and are wider at their portions other than their opening ends than at the opening ends. According to this construction, the spacing between the leading ends (or the opening ends) of the comb teeth need not set so wide unlike the connector jig of the related art as to match the enlarged terminal width. In this case, therefore, the engaging allowance between the flanged portions of the terminals and the edge portions of the opening ends can be enlarged to easily bear the load necessary for the press fit.

According to the aforementioned construction, on the other hand, even for the terminals having the bulged portions formed by the terminal bending works, the portions apart from the leading ends of the comb teeth are set so wide as to prevent the interference between the terminals and the comb teeth thereby to reduce their contact forces. When the connector jig is set, therefore, the terminals are not subjected to any excessive force so that they are prevented from being deformed thereby not to lower the yield of products.

According to a second aspect of the invention, there is provided a connector including a plurality of flanged terminals, which are protruded in a common direction from the housing a connector and bent midway in a common direction to extend in parallel and which are provided at their leading ends with press-fit portions and at their portions away from the leading ends with flanged portions bulged in a flange shape, further including: first terminals bent from the housing at positions spaced by a predetermined distance and extended in the height direction of the housing; and second terminals bent from the housing at positions spaced by a distance longer than the predetermined distance and extended in the height direction of the housing, wherein the first terminals have a bending radius smaller than that of the second terminals. Here, the reason why the bending radius of the side (or the first terminals) close to the housing is reduced is to retain the bending work radius between the housing and the terminals.

According to this construction, the connector further comprises: first terminals bent from the housing at positions spaced by a predetermined distance and extended in the height direction of the housing; and second terminals bent from the housing at positions spaced by a distance longer than the predetermined distance and extended in the height direction of the housing, and the first terminals have a bending radius smaller than that of the second terminals. Here, the reason why the bending radius of the side (or the first terminals) close to the housing is reduced is to retain the bending work radius between the housing and the terminals. In case there is used the connector jig having the groove portions corresponding to the individual terminals of the connector, therefore, the bulging amounts of the bent portions of the second terminals, as located at the deeper portions of the groove portions at the setting time, are smaller than the bulging amounts of the bent portions of the first terminals, as located at the shallower portions of the groove portions, so that the proximal portions of the groove portions of the connector jig can be made accordingly narrower. In other words, it is possible to adopt the construction, in which the proximal portions of the comb teeth can be made wider than the vicinities of the distal portions thereby to retain the strength of the connector jig and to improve the durability of the same.

According to a third aspect of the invention, there is provided a connector including a plurality of flanged terminals, which are protruded in a common direction from the housing a connector and bent midway in a common direction to extend in parallel and which are provided at their leading ends with press-fit portions and at their portions away from the leading ends with flanged portions bulged in a flange shape, further including: first terminals bent a plurality of times from the housing at positions spaced by a predetermined distance and extended in the height direction of the housing; and second terminals bent a plurality of times from the housing at positions spaced by a distance longer than the predetermined distance and extended in the height direction of the housing, wherein the individual bent portions are formed such that the bent portions of the first terminals close to the housing are located between the bent portions closer to the leading ends of the first terminals and the bent portions close to the leading ends of the second terminals.

According to this construction, the connector further comprises: first terminals bent a plurality of times from the housing at positions spaced by a predetermined distance and extended in the height direction of the housing; and second terminals bent a plurality of times from the housing at positions spaced by a distance longer than the predetermined distance and extended in the height direction of the housing, and the individual bent portions are formed such that the bent portions of the first terminals close to the housing are located between the bent portions closer to the leading ends of the first terminals and the bent portions close to the leading ends of the second terminals. At the time of setting the connector jig having the groove portions corresponding to the individual terminals of the connector, therefore, the bulging amounts of the individual bent portions of the first and second terminals to be inserted in the height direction of the housing into those groove portions can be dispersed to reduce the individual bulging amounts and to eliminate the overlap of the individual bent portions in the insertion direction. Therefore, the contact forces at the time when the terminals are inserted into the groove portions are reduced so that an excessive force is hardly applied to the terminals when the connector jig is set and so that the terminals are not deformed thereby to hardly lower the yield of products.

BRIEF DESCRIPTION OF THE DRAWINGS

FIG. 4A is a perspective view showing the deep groove shape of the connector jig;

FIG. 4B is a perspective view showing a portion of FIG. 4A;

FIG. 5A is a side elevation of the connector provided with another example of the modification of the terminal shape, FIG. 5B corresponds to FIG. 1C but presents an enlarged view of a portion of the connector jig;

DESCRIPTION OF THE PREFERRED EMBODIMENTS

Figure 1A:
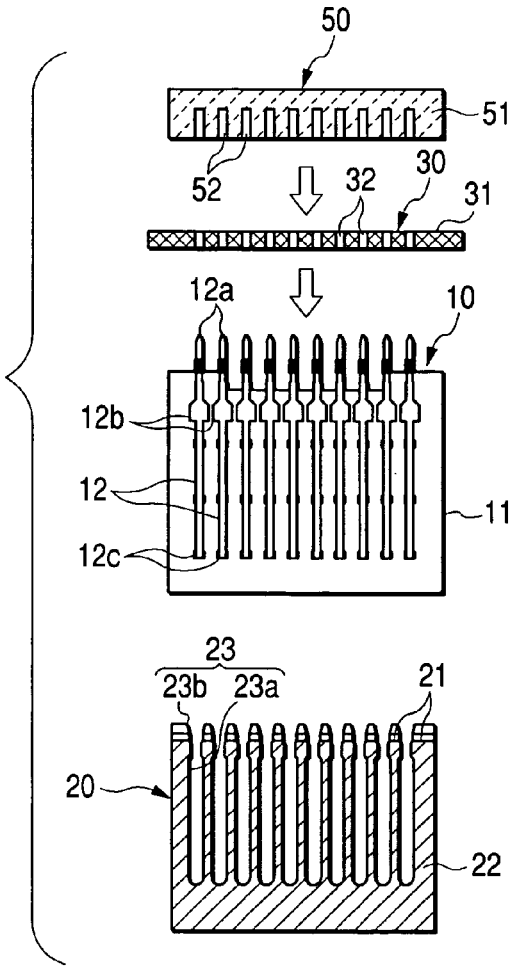
FIG. 1A is a front elevation containing a section taken along the terminal row closest to this side in a state before the terminals of a press-fit connector according to one embodiment of the invention are press-fitted in a board.
Figure 1B:
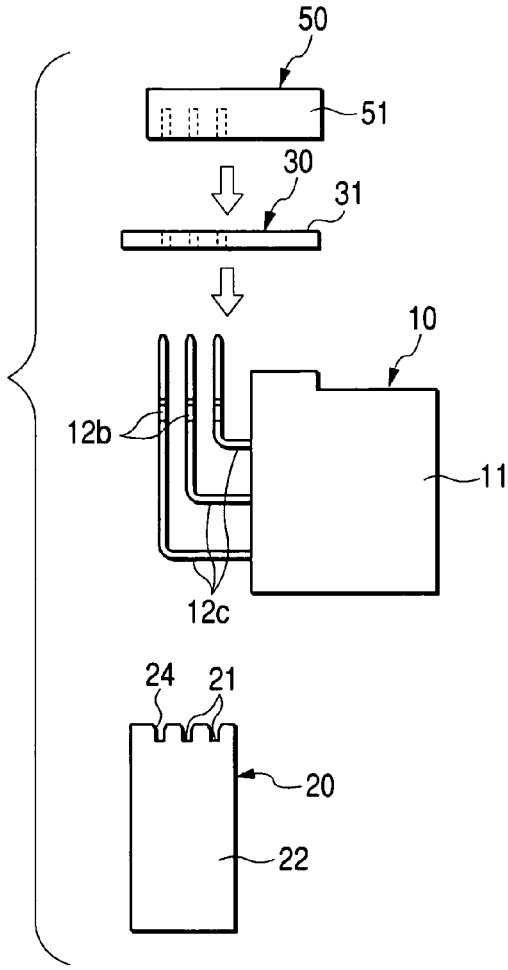
FIG. 1B is a side elevation of the press-fit connector according to one embodiment of the invention.
Figure 1C:
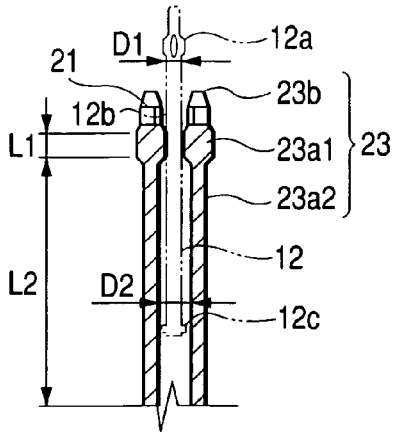
FIG. 1C is an enlarged view of a portion of FIG. 1B.
Figure 2A:
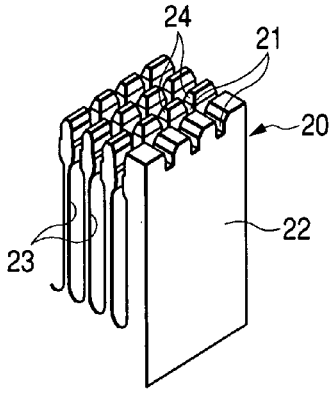
FIG. 2A is a perspective view showing a deep groove shape in a connector jig.
Figure 2B:
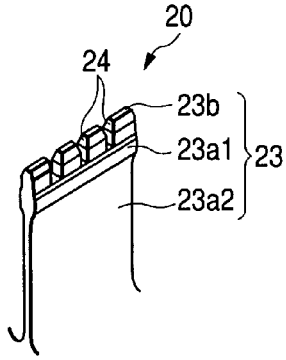
FIG. 2B is a perspective view showing a portion of FIG. 2A.

FIGS. 1A, 1B and 1C are views showing a state before the terminals of a press-fit connector according to one embodiment of the invention are press-fitted in a board. FIG. 1A is a front elevation containing a section taken along the terminal row closest to this side; FIG. 1B is a side elevation; and FIG. 1C is an enlarged view of a portion of FIG. 1B. FIGS. 2A and 2B are conceptional views of a connector jig.

FIG. 2A is a perspective view showing a deep groove shape, and FIG. 2B is a perspective view showing a portion of FIG. 2A. Here, blanked arrows in FIGS. 1A and 1B indicate the directions to mount the individual parts at the press-fitting time. Moreover, double-dotted lines in FIG. 1C indicate the state, in which the terminals are inserted into the grooves of the connector jig.

In FIGS. 1A to 1C and FIGS. 2A and 2B: reference numeral 10 designates a press-fit connector as an example of the connector; numeral 20 a connector jig as a jig for press-fitting the terminals of the press-fit connector 10; numeral 30 a printed-circuit board as the board; and numeral 50 a board jig.

As shown in FIGS. 1A to 1C, the press-fit connector 10 is provided with a housing 11 made of a synthetic resin into a generally rectangular shape, and pin-shaped terminals 12 made of a metal and extending in parallel from that housing 11. As shown, the individual terminals 12 are formed into an L-shape in a side view by protruding them horizontally from the housing 11 and then by bending them upward at a right angle. In order that the individual terminals 12 may not interfere with each other, moreover, the terminals 12 are arranged longitudinally (i.e., normally of the face of FIG. 1A and transversely of FIG. 1B) by three and transversely (i.e., transversely of FIG. 1A and normally of the face of FIG. 1B) by ten (that is, the terminals 12 closer to the housing 11 correspond to first terminals, and the terminals 12 remoter from the housing 11 correspond to second terminals). Here, the shapes and numbers of the individual terminals 12 are different in dependence upon the kind and size of the press-fit connector 10.

Each terminal 12 is provided: near its leading end portion with an elastic portion 12*a* as a press-fit portion, which is bulged in such a needle eye shape as can be elastically press-fitted in each through hole 32 of the printed-circuit board 30; and at its intermediate portion with a flanged portion 12*b*, which is so projected from the terminal body as to hook a pressure face 21 as an edge portion of the groove opening end of the connector jig 20.

Figure 9A:
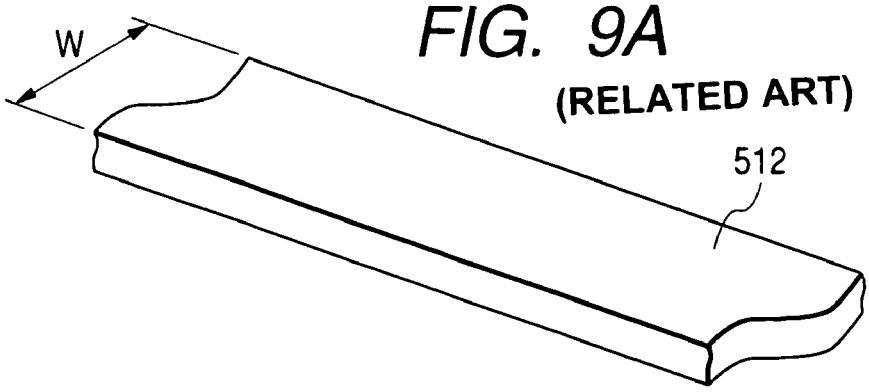
FIG. 9A (RELATED ART)
FIG. 9A is a perspective view of a portion showing the state before the bending treatment of the terminal.
Figure 9B:
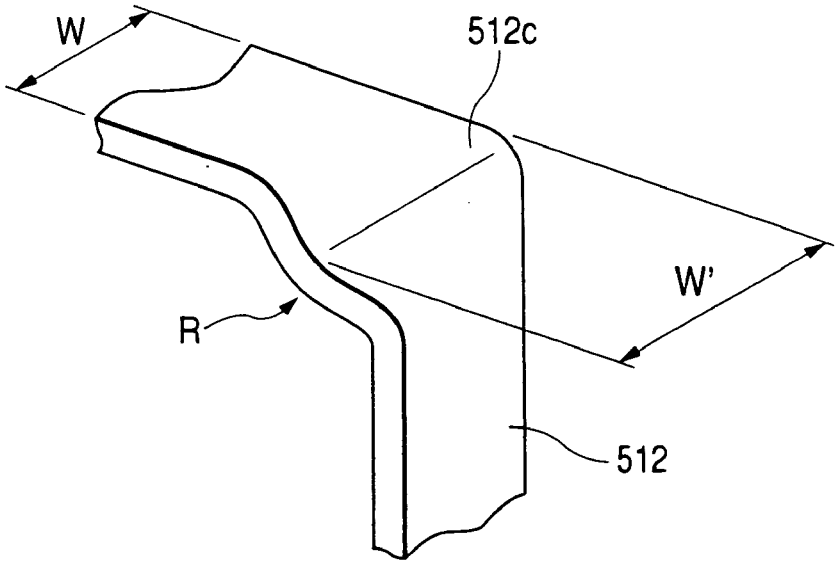
FIG. 9B (RELATED ART)
FIG. 9B is a perspective view of a portion showing the state after the bending treatment.
Figure 9C:
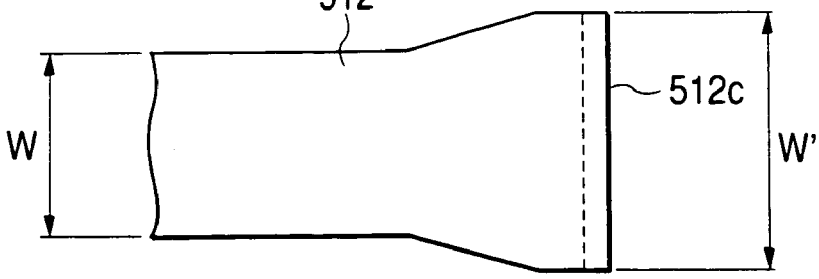
FIG. 9C (RELATED ART)
FIG. 9C is a top plan view of FIG. 9B.

On the other hand, each terminal 12 is formed by punching a material with a press into a flat plate shape having a predetermined terminal width W, as in the example of the related art shown in FIG. 9A, and then by bending the flat plate at a right angle to a predetermined radius R. However, this bent portion is flattened, as in FIGS. 9B and 9C, so that the terminal width W' becomes larger than the unbent portion (W'>W). The bulged portion at the bending time is left at the bent portion 12*c* of the terminal 12.

The connector jig 20 supports the individual terminals 12 at the press-fitting time and is provided with a generally rectangular jig body 22 made of a metal, deep grooves 23 as groove portions formed in transverse juxtaposition to each other in the jig body 22, and shallow grooves 24 formed in longitudinal juxtaposition to each other. As a result, the jig body 22 presents a deep comb-tooth shape, as viewed from the front face, and a shallow comb-tooth shape, as viewed from the side face.

The printed-circuit board 30 is provided with a sheet-shaped board body 31, and through holes 32 extending through the board body 31 at its portions corresponding to the individual terminals 12.

The board jig 50 pushes the printed-circuit board 30 at the press-fitting time and is provided with a jig body 51 of a thick plate shape. This jig body 51 is provided with bottomed holes 52 for protecting the individual terminals 12, which are extended through the individual through holes 32 of the printed-circuit board 30 and inserted thereinto.

Here, the deep grooves 23 induce the individual terminals 12 to position the flanged portions 12*b* transversely, and the shallow grooves 24 induce the individual terminals 12 to position the flanged portions 12*b* longitudinally.

For these actions, both the longitudinal grooves 23 and the transverse grooves 24 are tapered upward of the drawing to have slope faces and parallel faces. When the connector 10 is descended to insert the terminals 12 into the connector jig 20, the individual terminals 12 are smoothly guided along the slope faces and the parallel faces so that their flanged portions 12*b* are precisely arrayed both longitudinally and transversely on the pressure faces 21.

As shown in FIGS. 2A and 2B, the longitudinal groove 23 in the embodiment is formed to have a parallel face of two upper and lower steps. The upper step portion just below the slope face 23*b* is made wide (23*a*1), and the lower step portion is made narrow (23*a*2). Specifically, the spacing D1 between the upper step portions 23*a*1 is set slightly wider than the bent portion 12*c* of the terminal 12 but narrower than the flanged portion 12*b*. On the other hand, the spacing D2 between the lower step portions 23*a*2 is set far wider than the spacing D1 between the upper step portions 23*a*1. The reason for this difference will be explained in the following. The upper step portion 23*a*1 has a shorter height L1 so that it gives a smaller contact area to the terminal 12 passing the upper step portion 23*a*1. On the other hand, the lower step portion 23*a*2 has a longer height L2 so that it gives a larger contact area to the terminal 12 passing the lower step portion 23*a*2.

From the viewpoint for retaining the strength, however, the lower step portion 23*a*2 is required to have a predetermined or larger width. Therefore, the following modification is adopted for the terminal shape.

Figure 3A:
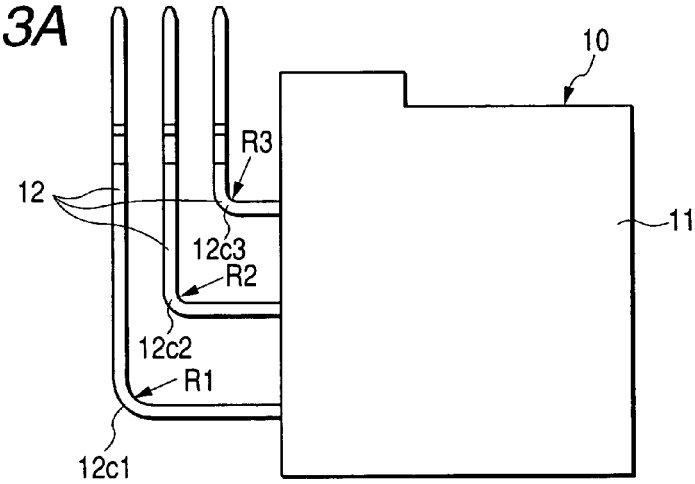
FIG. 3A is a side elevation of a connector provided with the modified terminals.
Figure 3B:
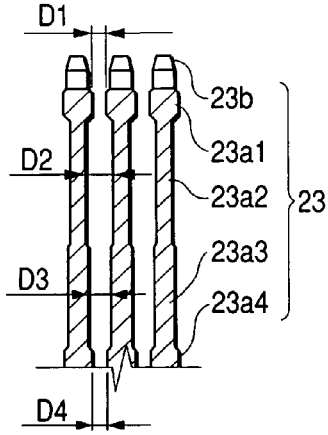
FIG. 3B corresponds to FIG. 1C but presents an enlarged view of a portion of the connector jig.

FIG. 3A and FIG. 3B show one modification of the terminal shape. FIG. 3A is a side elevation of a connector provided with the modified terminals, and FIG. 3B corresponds to FIG. 1C but presents an enlarged view of a portion of the connector jig. FIGS. 4A and 4B are conceptional views of the connector jig. FIG. 4A is a perspective view showing the deep groove shape, and FIG. 4B is a perspective view showing a portion of FIG. 4A.

Of the individual terminals 12, as shown in FIG. 3A, the terminal 12 closest to the housing 11 (as located on the righthand side of the drawing) has to retain the minimum bending radius (or the bending work radius) for the bending work between the housing 11 and that terminal. However, this restriction is not exerted on the terminals apart from the housing 11 (as located on the lefthand side of the drawing). In this modification, therefore, the terminals 12 have the smaller bending radii as they come the closer to the housing 11. In short, the bent portions 12*c*1, 12*c*2 and 12*c*3 have bending radii R1, R2 and R3 (R1>R2>R3), respectively. In this case, the bulging amount is inversely proportional to the bending radius so that the bent portions 12*c*1, 12*c*2 and 12*c*3 have larger bulging amounts in the recited order. As shown in FIG. 3B, therefore, the spacings D1, D2, D3 and D4 between the deep grooves 23 (i.e., 23*a*1, 23*a*2, 23*a*3 and 23*a*4) of the connector jig 20 are set to D2>D3>D4>D1.

In other words, the guide portions 23*a*1, 23*a*2, 23*a*3 and 23*a*4 below the inducing portion 23*b* of the deep groove 23 are formed into a four-step construction, as shown in FIGS. 4A and 4B, in which the highest step is widest, in which the next high step is the narrowest, and in which the lower steps are made wider downward in the recited order. Thus, the proximal portion of the deep groove 23 can be made narrower. In other words, the proximal portion of the comb tooth can be made wider than the vicinity of the distal portion thereby to retain the strength of the connector jig 20.

In this modification, it is necessary and may be troublesome to bend the terminals 12 by changing the bending radii. Especially for the larger bending radius, the bending work has to consider the spring back. Therefore, the invention has adopted a terminal shape according to the following modification.

Figure 6A:
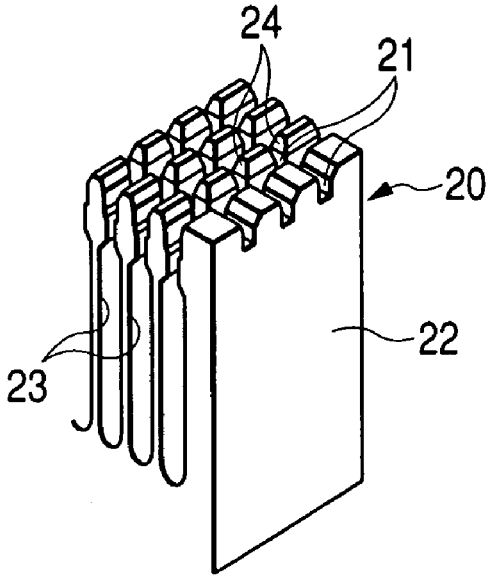
FIG. 6A is a perspective view showing the deep groove shape.
Figure 6B:
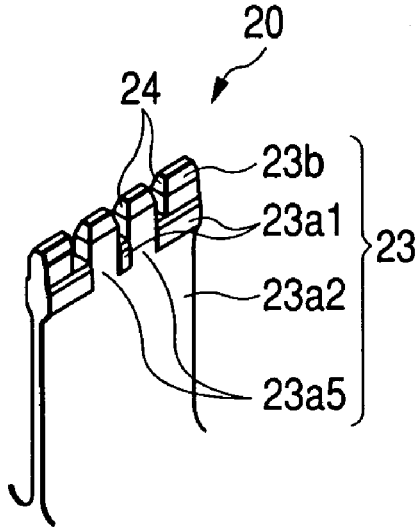
FIG. 6B is a perspective view showing a portion of FIG. 6A.
Figure 7A:
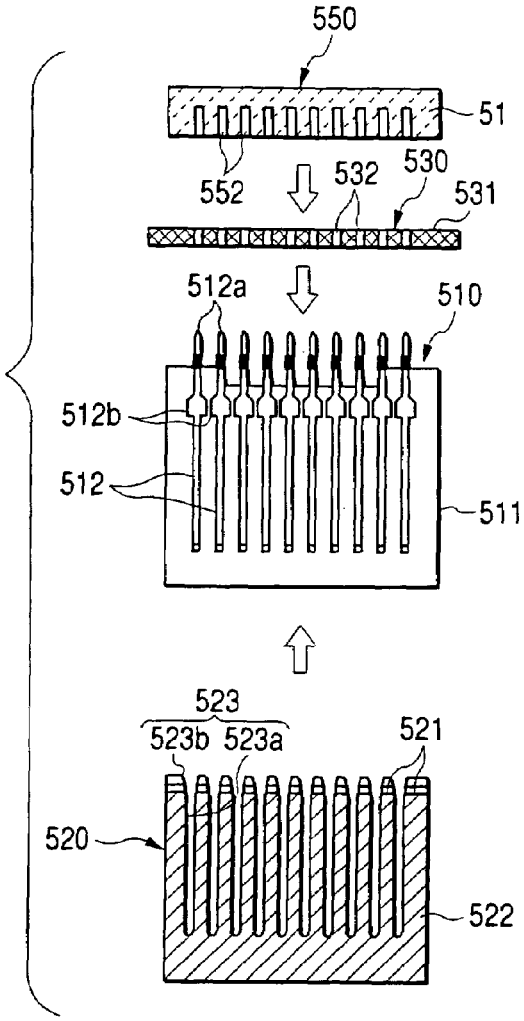
FIG. 7A (RELATED ART)
FIG. 7A is a front elevation containing a section taken along a terminal row closest to this side in a state before the terminals of a conventional press-fit connector are press-fitted in a board.
Figure 7B:
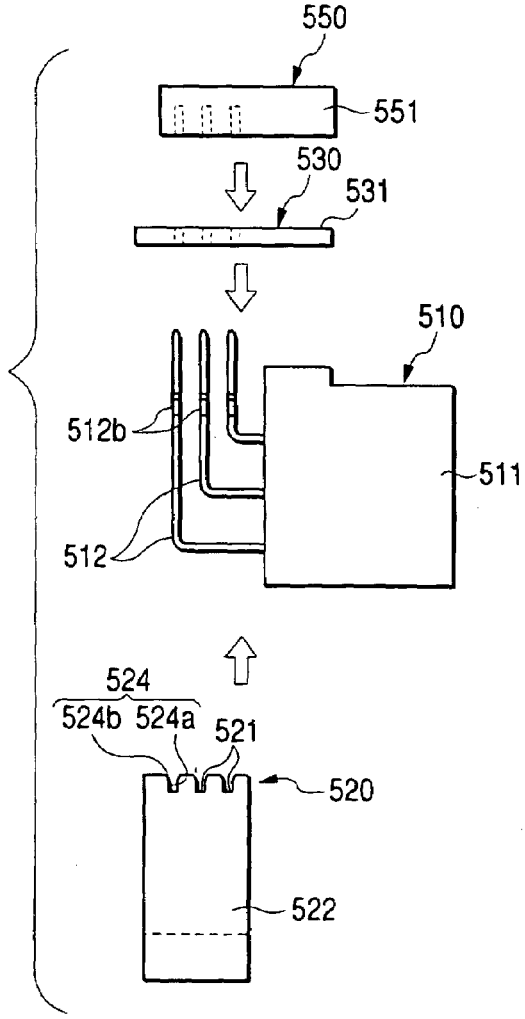
FIG. 7B (RELATED ART)
FIG. 7B is a side elevation of the conventional press-fit connector.
Figure 7C:
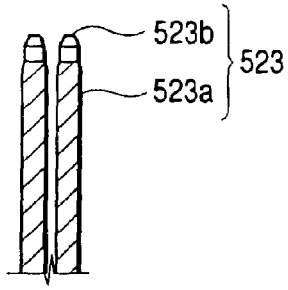
FIG. 7C (RELATED ART)
FIG. 7C is an enlarged view of a portion of FIG. 7A.
Figure 8A:
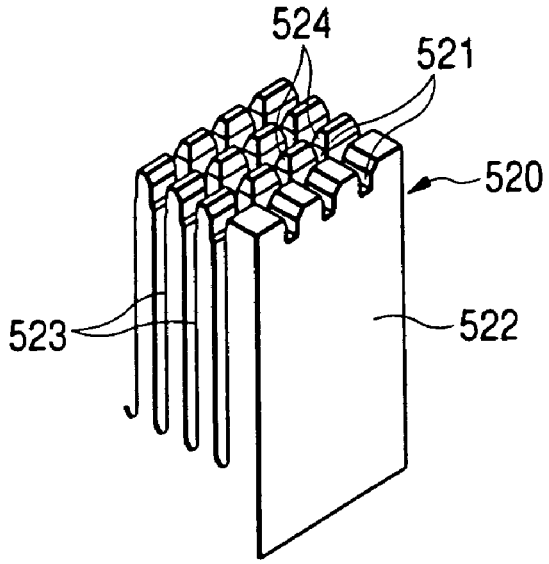
FIG. 8A is a perspective view showing a deep groove shape.
Figure 8B:
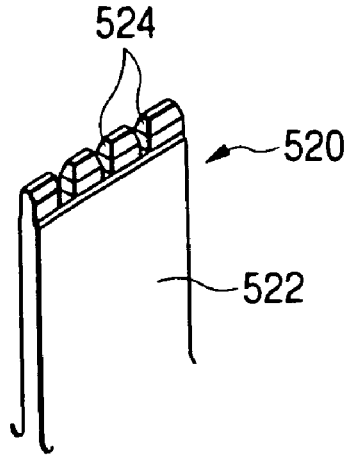
(RELATED ART) FIG. 8B
FIG. 8B is a perspective view showing a portion of FIG. 8A.

FIGS. 5A and 5B show another example of the modification of the terminal shape. FIG. 5A is a side elevation of the connector provided with the modified terminals, and FIG. 5B corresponds to FIG. 1C but presents an enlarged view of a portion of the connector jig. FIGS. 6A and 6B are conceptional views of the connector jig. FIG. 6A is a perspective view showing the deep groove shape, and FIG. 6B is a perspective view showing a portion of FIG. 6A. Here, the connector jig shown in FIG. 5B is partially in the widthwise direction so that the widthwise number of terminals does not coincide to the actual one. Moreover, the hatched portions of FIG. 5B indicate the deep groove portions.

In FIG. 5A, bent portions 12*c*1', 12*c*2' and 12*c*3' are individually composed of a plurality of (e.g., two) bent portions. The individual bent portions have equal bending radius, although not explicitly specified. However, these bent angles are smaller than those of the bent portions 12*c* of the terminals 12 of FIGS. 1A to 1C (as equalized to halves, although not always needed so). Therefore, it is possible to understand that the individual bent portions 12*c*1', 12*c*2' and 12*c*3' have smaller bulging amounts. Here, one (e.g., the bent portion ④, ⑤ or ⑥ other than those closer to the housing 11, as shown) of the two bent portions is located on the side of the direction for the terminals to extend so that it does not overlap the other bent portions). However, the other bent portion (e.g., the bent portion ①, ② or ③ closer to the housing 11, as shown) can be selected at any position so long as its bent position might be located between the aforementioned on bent portion and the housing 11). If the bent position is freely selected, however, the bent portions overlap in the height direction of the housing 11 so that the contact forces between the bent portions 12*c*1', 12*c*2' and 12*c*3' and the side walls of the deep grooves 23 will increase.

In the embodiment, therefore, the bent portions are prevented from overlapping each other in the height direction of the housing 11. Specifically: the bent portion 12*c*1' or ① is located on an axis c1 between the terminal 12 spaced the most from the housing 11 and the next spaced terminal 12; the bent portion 12*c*2' or ② is located on an axis c2 between the next spaced terminal 12 and the terminal 12 the closest to the housing 11; and the bent portion 12*c*3' or ③ is located on an axis c3 between the closest terminal 12 and the housing 11. Thus, any bent portion is so arranged as not to overlap others on a common axis.

As shown in FIGS. 6A and 6B, therefore, the bent portions 12*c*1', 12*c*2' and 12*c*3' or ④, ⑤ and ⑥ have relations to the engaging allowances of the flanged portions 12*b* of the terminals 12 so that the groove widths can be made as large as those of FIGS. 2A and 2B thereby to reduce their contact areas. The bent portions 12*c*1', 12*c*2' and 12*c*3' or ①, ② and ③ have no relation to the engaging allowances of the flanged portions 12*b* of the terminals 12 so that the groove width can be large (at 23*a*5) even under the pressure faces 21 thereby to reduce the contact forces. Moreover, the bending radii of the terminals 12 may be equal so that no trouble is encountered by the bending works.

The press-fit connector 10 is brought into a supported state, in which its individual terminals 12 are abutting against the pressure faces 21, by inserting the connector jig 20 in the height direction of the housing 11 from its proximal side having the bent portions 12*c* or the like of the terminals 12 and by guiding the terminals 12 with the deep grooves 23 and the shallow grooves 24. After this, the individual terminals 12 are press-fitted into the printed-circuit board 30 by pushing the board jig 50 such that the printed-circuit board 30 abutting on its back against the board jig 50 confronts the individual terminals 12 supported by the connector jig 20 of the press-fit connector 10.

According to the embodiment, as has been described hereinbefore, the deep grooves 23 are set to have a larger groove width D2 below the opening end than the groove width D1 at the opening end so as to reduce the contact area between portions 23*a* of the deep grooves 23 of the connector jig 20 for guiding the terminals 12 and the portions 12*c* bulged by bending the terminals 12. Unlike the connector jig 520 of the related art, therefore, the spacing of the comb-tooth ends (or the opening ends) need not be set so wide as to match the enlarged terminal width. In this case, therefore, the engaging allowance between the flanged portions 12*b* of the terminals 12 and the comb-tooth ends can be enlarged to easily bear the load necessary for the press fit.

According to the embodiment, on the other hand, the guide portions 23*a*2 and so on below the opening ends of the deep grooves 23 are set wide so that the terminals 12 and the deep grooves 23 do not interfere thereby to reduce their contact forces. Therefore, an excessive force is not applied to the terminals 12 when the connector jig 20 is set, so that the terminals 12 are not deformed thereby not to lower the yield of products.

The embodiment has been described on the connector jig 20 having both the deep grooves 23 and the shallow grooves 24 in the jig body 22. However, the invention can be applied to a connector jig 20 having at least the deep grooves 23.

In the embodiment, moreover, the deep grooves 23 are formed in multiple steps in the height direction. However, the steps may be integrated to a smaller number or may be partially or wholly tapered.

In the embodiment, moreover, the individual terminals 12 protruding from the housing 11 of the press-fit connector 10 are bent at a right angle upward of the housing 11. However, the terminals 12 may be bent downward or not by 90 degrees but by 45 degrees.

In the modification of the embodiment, moreover, the connector jig 20 is formed to have the deep grooves matching the bent shape of the press-fit connector 10. However, the connector jig 520 of the related art may be applied to the press-fit connector 10 of the modification. In this case, too, the terminals 12 and the comb teeth more hardly interfere than the combination with the connector of the related art thereby to reduce their contact forces.

According to the invention, the spacing between the leading ends (or the opening ends) of the comb teeth need not set so wide unlike the connector jig of the related art as to match the enlarged terminal width. In this case, therefore, the engaging allowance between the flanged portions of the terminals and the edge portions of the opening ends can be enlarged to easily bear the load necessary for the press fit.

According to the constructions thus far described, on the other hand, the portions apart from the leading ends of the comb teeth are set so wide as to prevent the interference between the terminals and the comb teeth thereby to reduce their contact forces. When the connector jig is set, therefore, the terminals are not subjected to any excessive force so that they are prevented from being deformed thereby not to lower the yield of products.

What is claimed is:

1. A connector press-fitting jig for press-fitting a plurality of flanged terminals, each flanged terminal having a bent portion, a flanged portion and a press-fit portion, the bent portion protruding in a first direction from a housing of a connector and bending midway to extend in a second direction, the press-fit portion being disposed at a leading end of the flanged terminal and the flanged portion being disposed between the leading end and the bent portion with the flanged portion bulging in a flange shape in a third direction other than the second direction, wherein the press-fit portion is inserted into a through hole of a board by guiding the flanged terminal with the connector press-fitting jig, composing:

a first jig body having a comb-tooth shape on a pressure face; and a second jig body opposite the board from a side facing the connector, wherein the comb-tooth shape of the first jig body includes a plurality of longitudinal and transverse groove portions corresponding to the flanged terminals, wherein each longitudinal groove portion of the longitudinal groove portions has an opening end to receive the flanged portion, the opening end having an opening width larger than a bent width of the bent portion of the flanged terminal and smaller than a flange width of the flange portion, each longitudinal groove portion has an interior portion beyond the opening end, the interior portion having an interior width larger than the bent width, each transverse groove portion of the plurality of transverse groove portions receives flange portions of a set of the flanged terminals, and the second jig body includes a plurality of bottomed holes, each bottomed hole corresponding to and guiding the press-fit portion into the through hole of the board.

2. A connector press-fitting method, comprising the steps of:

preparing a connector having at least one flanged terminal having a bent portion, a flanged portion and a press-fit portion, the bent portion protruding in a first direction from a housing of the connector and bending midway to extend in a second direction, the press-fit portion being disposed at a leading end of the flanged terminal and the flanged portion being disposed between the leading end and the bent portion with the flanged portion bulging in a flange shape, preparing a board jig for a board disposed between the board jig and the connector, the board jig having at least one bottomed hole corresponding to the at least one flanged terminal;

preparing a connector press-fitting jig having;

a transverse groove portion that receives the flange portion, a longitudinal groove portion having an opening width for receiving the press-fit portion of the flanged terminal, the opening width being larger than a bent width of the bent portion of the flanged terminal, and the opening width being smaller than the flange portion, an opening end corresponding to the opening width, and an interior portion having an interior width being larger than the bent portion;

guiding the flanged terminal of the connector along the second direction with the longitudinal groove portion and the transverse groove portion of the connector press-fitting jig; and press-fitting the connector into the through hole of the board by the guiding step.

3. A connector, wherein the connector is manufactured by the connector press-fitting method as set forth in claim 2.

* * * * *